US006138881A

United States Patent [19]

Paul et al.

[11] Patent Number: 6,138,881

[45] Date of Patent: Oct. 31, 2000

[54] CONVERTIBLE BACKPACK/SHOULDER BAG

[75] Inventors: Jeanne Paul; Lauren Candelaria, both of Portland, Oreg.

[73] Assignee: Norm Thompson Outfitters, Inc., Portland, Oreg.

[21] Appl. No.: 09/396,844

[22] Filed: Sep. 15, 1999

[51] Int. Cl.[7] ..... A45F 3/02; A45F 3/04

[52] U.S. Cl. ..... 224/153; 224/578; 224/579; 224/627; 224/645

[58] Field of Search ..... 224/575, 153, 224/578, 579, 580, 627, 645

[56] References Cited

U.S. PATENT DOCUMENTS

| | | | |
|---|---|---|---|
| 294,622 | 3/1884 | Honinger | 224/578 |
| D. 312,726 | 12/1990 | Kline . | |
| D. 315,825 | 4/1991 | Hutton et al. . | |
| D. 340,351 | 10/1993 | Wrath . | |
| D. 359,847 | 7/1995 | Callegari . | |
| D. 362,752 | 10/1995 | Steurer | 224/645 X |
| D. 363,599 | 10/1995 | Gaffin . | |
| D. 376,686 | 12/1996 | Daboudet . | |
| D. 390,352 | 2/1998 | Lane . | |
| D. 403,497 | 1/1999 | Gethner . | |
| D. 404,563 | 1/1999 | Rausch . | |
| 2,563,766 | 8/1951 | Weinstein et al. | 2/326 |
| 3,346,155 | 10/1967 | Oechsle . | |
| 3,530,919 | 9/1970 | May | 224/645 X |
| 3,790,049 | 2/1974 | Bohanec . | |
| 4,085,873 | 4/1978 | Scweitzer | 224/153 |
| 4,153,092 | 5/1979 | Haslam . | |
| 4,273,274 | 6/1981 | Freistadt . | |
| 4,810,102 | 3/1989 | Norton . | |
| 5,187,823 | 2/1993 | Ferguson et al. | 224/153 |
| 5,377,887 | 1/1995 | Garcia . | |
| 5,407,112 | 4/1995 | Christodoulou et al. . | |
| 5,431,317 | 7/1995 | Kliot . | |
| 5,529,229 | 6/1996 | Fier | 224/153 |
| 6,006,974 | 12/1999 | Varney et al. | 224/645 |

FOREIGN PATENT DOCUMENTS

| | | | |
|---|---|---|---|
| 2754061 | 6/1979 | Germany | 224/209 |
| 237539 | 8/1945 | Norway | 224/209 |
| 94028761 A1 | 6/1979 | WIPO | 224/209 |

OTHER PUBLICATIONS

Spiegel F/W; 1997—p. 01, Item G, Backpack "adjustable straps convert . . . to shoulder sling . . . ".

*Primary Examiner*—Gregory M. Vidovich
*Attorney, Agent, or Firm*—ipsoon llp

[57] ABSTRACT

An ergonomically designed bag is configured with a strap system that is easily converted from a two-strap backpack mode into a single-strap shoulder bag mode. The carrying strap is attached at a first end to the top of the bag. The strap is longitudinally dividable with a zipper incorporated into the strap. When in the backpack mode the zipper is open to define a pair of straps, the lower ends of which are connected to D-rings on lateral sides of the front panel. When in the shoulder bag mode the zipper is closed and the lower ends of both straps are connected to a D-ring on a side panel of the bag.

11 Claims, 3 Drawing Sheets

CONVERTIBLE BACKPACK/SHOULDER BAG

FIELD OF THE INVENTION

This invention relates to tote bags and backpacks, and more specifically to an improved bag of this kind having an ergonomic design which incorporates a strap system that allows the bag to be easily converted from a backpack into a shoulder bag.

BACKGROUND AND SUMMARY OF THE INVENTION

Traditional backpacks are worn on the user's back and incorporate a well-known two-strap system that requires one strap to be worn over each shoulder. While there are many variations on the strapping systems used in backpacks, nearly all backpacks rely upon this basic two-strap arrangement. On the other hand, a shoulder bag is a type of bag that is worn on the user's back, except with a shoulder bag only a single strap is slung over one of the user's shoulders. Whether a bag is worn as a backpack or a shoulder bag depends to some extent upon the type of activity in which the user is engaged. For instance, when a bag is being used while hiking it is advantageous to wear a backpack since the two-strap system provides a more stable and secure manner of carrying a load, and leaves both hands free for other uses. On the other hand, when shoulder bag is used it is easier to access the contents of the bag. But because the bag is less stable when worn as a shoulder bag than when worn as a backpack, it is often necessary to adjust the position of the strap or the bag itself.

A backpack may be worn as a shoulder bag—that is, with only one of the two straps slung over one shoulder. However, when worn in this fashion the unused backpack strap is often in the way. Furthermore, the backpack bag may not be designed for use in this manner and may not be very comfortable. A single-strap shoulder bag may not, of course, be worn as a two-strap backpack.

The advantages of a bag that is convertible from a traditional two-strap backpack arrangement into single-strap shoulder bag have been recognized for many years. These advantages include the ability to readily move the bag from one orientation to another and in this way relieve stress on the user's back by moving the bag from one carrying position to another. This can be important when the bag is used to carry relatively heavy or bulky loads, such as schoolbooks. Other advantages include the ability to wear the bag in different orientations depending upon the user's specific needs. For instance, the bag may be worn as a backpack when the user is hiking, and may be worn as a shoulder bag when the user has a need to access the contents of the bag quickly.

Ergonomic considerations in the design of backpacks are equally important as the basic design of the bag and the strap system. Over the past years designers have come to recognize that the usability of bags and luggage, like many other useful articles, can be greatly improved by designing the products in such a manner that pays attention to the how the user interacts with the products. By paying attention to how the bag is used, how it is worn, and by other factors, and by designing the bag in a manner that allows it to conform to the user's normal body positions and uses, the bag may be made much more "user-friendly" and comfortable.

However, while strap systems that allow bags to be converted from a backpack to a shoulder bag are known, ergonomic design principals have not been incorporated into past designs of such convertible backpacks and shoulder bags. As a result, known convertible backpacks/shoulder bags are unwieldy. To facilitate convertibility of a bag from a backpack into a shoulder bag, the bag must typically include a strap system that allows the bag to be used with either two straps—slung over each shoulder for the traditional backpack arrangement—or a single strap worn over one shoulder as a shoulder bag. But known convertible bags generally incorporate inconvenient strapping systems that are difficult to manipulate and convert. For example, when the bag is used as a shoulder bag, the second strap, which is necessary for use as a backpack, may be free and thus in the way. Other bags have strapping systems that are difficult to manipulate between the orientation required for the backpack mode and the orientation required for the shoulder strap mode.

In addition, the design of the bag itself must be taken into account when designing a bag that is to be worn as a backpack and as a shoulder bag. Since the bag rests on the user's back in a relatively different position when worn as a backpack, a traditional backpack design may not be comfortable when worn as a shoulder bag. Thus, a bag designed strictly for use as a backpack may not be well suited for use as a shoulder bag. Likewise, a bag designed for use only as a shoulder bag may not be very comfortable when used as a backpack.

One example of a convertible bag is shown in U.S. Pat. No. 4,153,092. In that patent the bag has a pair of straps that may be buttoned together to create a single shoulder strap, or alternately separately buttoned to the bag to create paired straps for use as a backpack. The button systems shown in this bag is an example of a system that would be difficult to manipulate. Moreover, the bag is not designed for comfortable transition from the backpack mode into the shoulder bag mode.

There is a need, therefore, for a bag that is easily converted from a backpack mode to a shoulder bag mode, and which is ergonomically designed so that the bag is comfortable to wear in either mode.

The bag of the present invention accomplishes these and other objects. The bag is generally triangular or teardrop shaped and incorporates padding on the lower panels where the bag rests against the user's back. The strap system of the bag of the present invention allows for easy multimode conversion between a single and double strap. Regardless of which mode, backpack or shoulder bag is selected, the upper end of the strap is attached to the top of the bag, near the apex of the triangular bag with a swivel connector. A zipper is sewn into the strap longitudinally along the length thereof, creating a longitudinally dividable strap having two arms when the strap is divided, and one arm when the strap is undivided. When the bag is being used as a backpack, the zipper is unzipped to create a strap having one upper end and two separate lower ends. Each lower end is separately connected to a ring on a lower edge of the bag. This creates a traditional two-strap backpack arrangement. When the bag is being used as a shoulder bag, the longitudinally split strap is connected along its length by closing the zipper. Both lower ends of the strap are disconnected from the rings on the lower edge of the bag and are connected to a ring on a side edge of the bag, thus creating a single-strap bag. This strap arrangement allows for easy conversion from one mode to another. The teardrop shape of the bag allows the bag to be worn comfortably in either orientation.

DETAILED DESCRIPTION OF PREFERRED EMBODIMENTS

Figure 1:
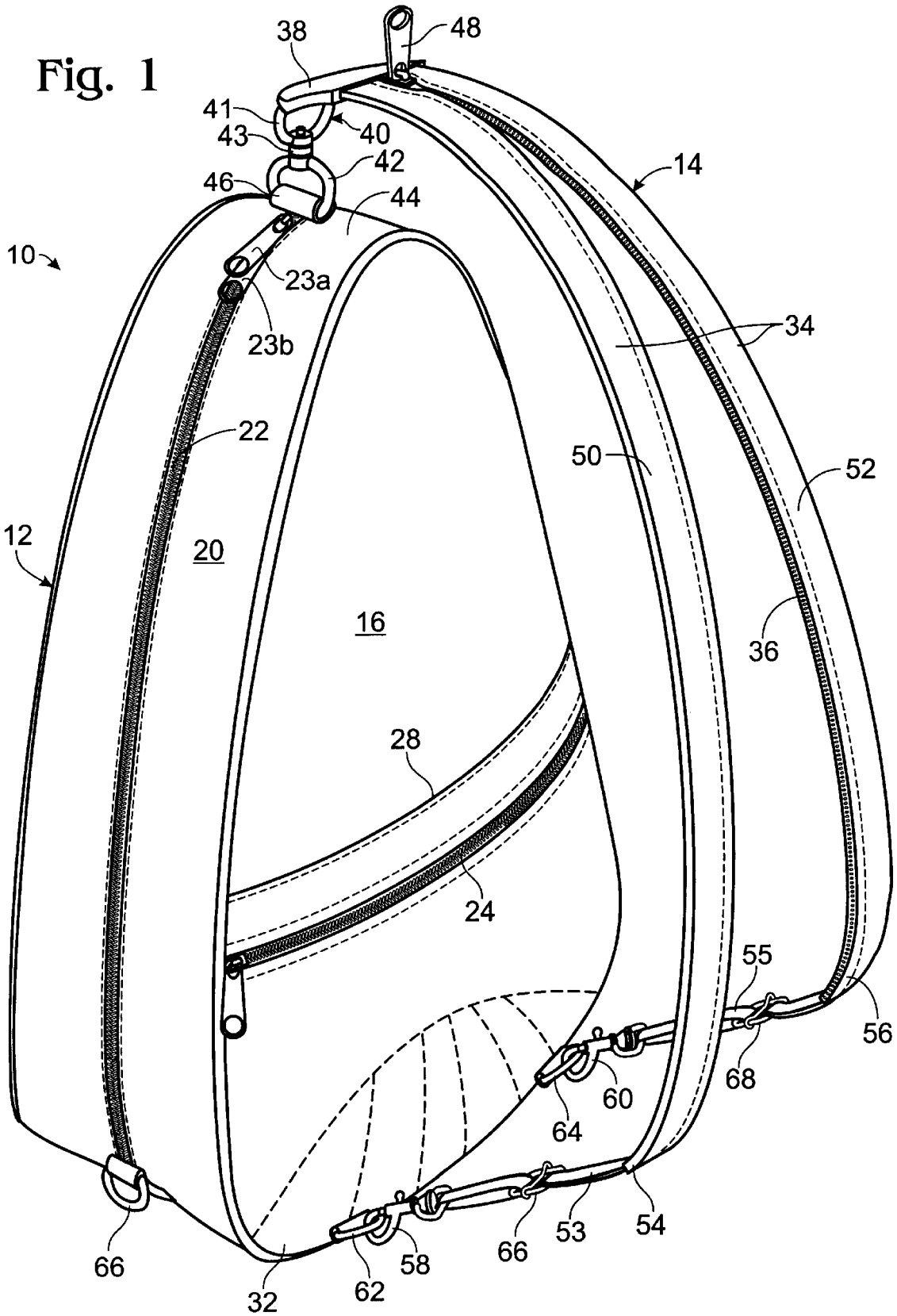
FIG. 1 is a perspective view of the convertible backpack/shoulder bag of the present invention showing the strap system configured in the two-strap backpack mode.

The preferred embodiment of a convertible backpack/shoulder bag 10 according to the present invention is shown in FIG. 1, including a bag portion generally designated with reference number 12, and a multipositional and multifunctional strap system 14. Bag 12 is generally triangular or teardrop in shape, with generally rounded corners.

Bag 12 comprises a series of interconnected panels that form the walls of the bag. These include front and rear panels 16 and 18, respectively (FIGS. 3 and 4), which are interconnected by a side/bottom panel 20 that extends continuously around the periphery of bag 12 to form a continuous side wall and bottom wall extending around the bag. For reference herein, front panel 16 refers to the side of bag 12 that is worn against the user's back when the bag is worn as a backpack. This naming convention is used throughout. Thus, rear panel 18 faces rearward, away from the user when the bag is being worn as a backpack.

Figure 4:
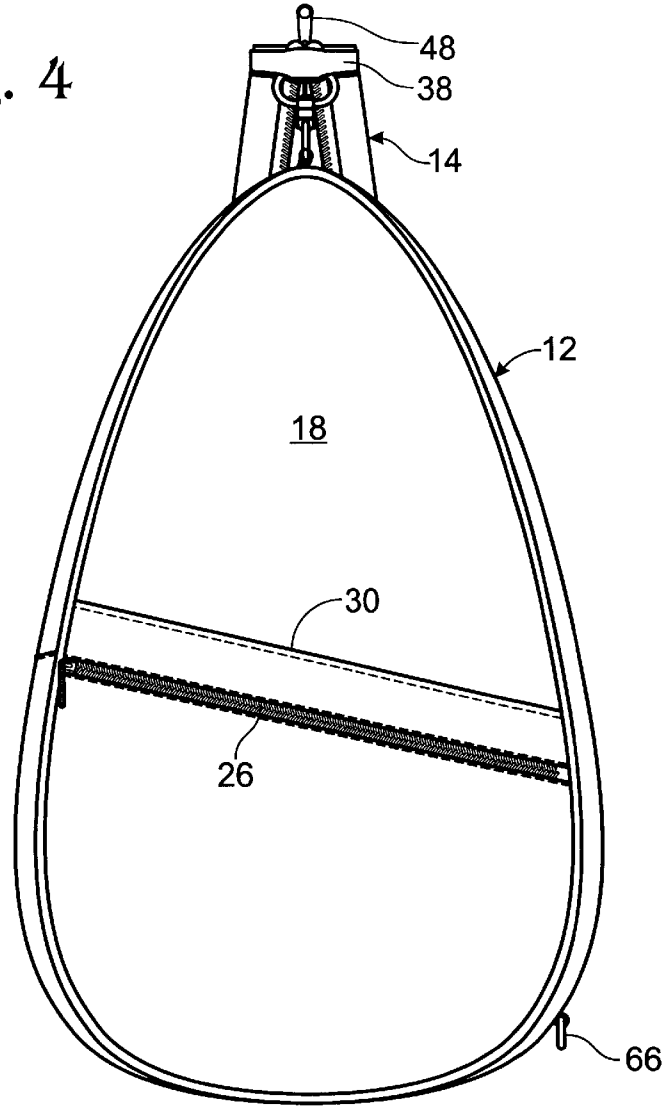
FIG. 4 is an elevational view of the rear side of the bag of the present invention, showing the strap system arranged as shown in FIG. 1, in the backpack mode.

A zipper 22 is provided in side panel 20 to define an opening into a central compartment for storage of items to be carried in the bag. Zipper 22 is preferably a standard two-way zipper having two zipper pulls, 23*a* and 23*b*. The bag includes various pockets and pouches for added storage. For instance, a zipper 24 is provided in front panel 16 to form a pocket for storage of items such as valuables. When the bag is being used in the backpack mode, front panel 16 rests against the user's back. The pocket formed by zipper 24 is thus inaccessible when the backpack is being worn, providing a security feature. As shown in FIG. 4, a similar pocket is formed on rear panel 18 with a zipper 26. Both the front and rear panels further include pouches 28, 30, respectively. Pouches 28 and 30 comprise a seam formed laterally across the front and rear panel to define an opening into the pouch. The pouches may be closed with any suitable closure such as a hook and eyelet-type fastener.

The lower portion of front panel 16 includes a padded region 32 positioned to provide extra comfort where the bag rests on the user's back, and therefore to relieve back stress. The padding is sewn into the lining of bag 12 in a well-known manner. In the figures the padded region 32 is shown in phantom lines. The padded region may also extend across the bottom of the bag across panel 20, although this is not shown in the figures.

Bag 12 may be made of any suitable material, including nylon or other fabrics, or leather. The material may include waterproof linings or may itself be waterproof, as well known in the art.

Figure 2:
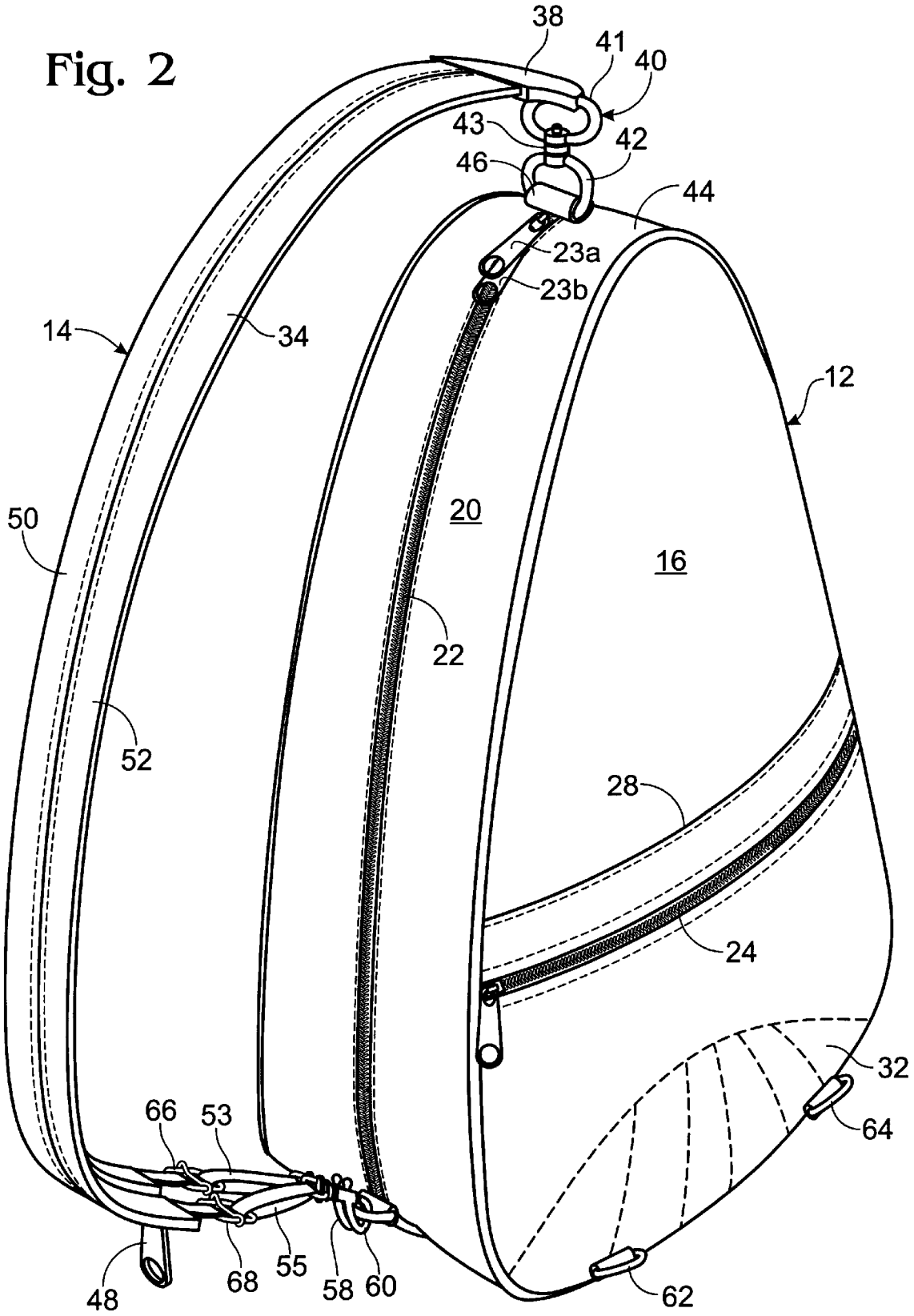
FIG. 2 is a perspective view of the convertible backpack/shoulder bag of the present invention showing the strap system configured in the alternate single-strap shoulder bag mode.

As noted above, the strap system 14 can be easily converted from a single-strap for the shoulder strap mode into a double strap for the backpack mode. The double strap mode is shown in FIG. 1. The single strap mode is shown in FIG. 2.

The strap system 14 comprises a single strap 34 that includes a zipper 36 extending longitudinally along the strap. The first end 38 (or upper end) of strap 34 is connected with a double-ring swivel connector 40 (comprising an upper ring 41 interconnected to a lower ring 42 with a swivel 43) connected with a suitable strap 46 to the top of the bag, which in the figures is at apex 44 of bag 12. Thus, the first end of strap 34 has a single point of attachment to the bag that includes the ability to swivel. Strap 46 is attached to the bag with appropriate reinforced stitching to prevent the strap from parting from the bag.

Swivel connector 40 is connected to bag 12 on panel 20 approximately midway between the intersection of panel 20 and front panel 16 and rear panel 18. This allows the strap to be reoriented relative to the bag as shown in FIG. 2 when the bag is in the shoulder bag mode, and such that the strap is oriented completely over side panel 20. Further, the use of a swivel for attachment of the upper end of the strap to the bag provides for greater comfort and flexibility in the positioning of the bag on the wearer's body. The area where zipper 36 is sewn into first end 38 of strap 34 is suitably reinforced in known manners.

Zipper 36 selectively divides and reconnects the strap longitudinally. Thus, when zipper 36 is open the zipper pull 48 is located near first end 38 of strap 34, dividing the strap to define two separate strap arms, a first strap arm 50 and a second strap arm 52. The second or lower ends of straps arms 50 and 52, identified with reference numbers 54 and 56, respectively, are connected to extensions loops 53 and 55, respectively, that in turn are each are fitted with a releasable swivel fastener 58, 60, respectively. The extension loops are preferably made of nylon webbing or a similar strong fabric and are sewn or otherwise suitably connected to the lower ends of the strap arms in a loop fashion (FIGS. 1 and 2). Swivel fasteners 58 and 60 are preferably of the type that are easily alternately connected to and disconnected from rings 62 and 64, located at the lower lateral corners of bag 12 on front panel 16 near the bottom of the bag. Rings 62 and 64 are connected to bag 12 with, for example, straps similar to strap 46, and may be reinforced in a like manner. In the preferred embodiment rings 62 and 64 are standard metal D-rings. However, any suitable attachment ring such as plastic or nylon loops, or button loops will function equally as well. Standard slide-type adjusters 66 and 68 are included in extension loops 53 and 55, respectively, to allow the relative length of straps 50 and 52 to be independently adjusted to suit the needs of the user.

Figure 3:
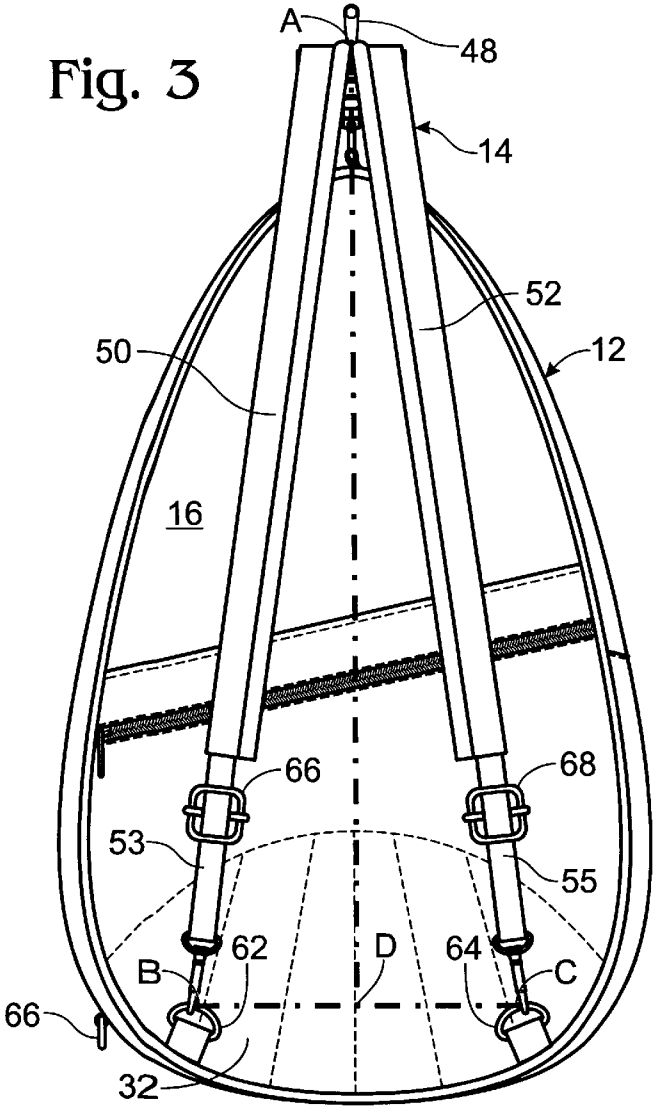
FIG. 3 is an elevational view of the front side of the bag of the present invention, showing the strap system arranged as shown in FIG. 1, in the backpack mode.

When the bag is to be worn as a backpack, strap system 14 is adjusted so that zipper 36 is open as shown in FIGS. 1 and 3. This defines a two-strap arrangement with first strap arm 50 and second strap arm 52. The length of each strap arm may be separately adjusted with adjusters 66 and 68. Moreover, adjustment of the position of pull 48 of zipper 36 allows the user to adjust the position that bag 12 rests on the user's back when the bag is worn as a backpack. As may be seen in FIG. 3, the combination of rings 62 and 64 and pull 48 of zipper 36 defines an area in the shape of a triangle. This area is shown in FIG. 3 with the lines that extend between points A, B, and C corresponding to pull 48 and rings 62 and 64, respectively. The center point along line B-C is labeled point D. When bag 12 is being worn as a backpack, the two straps are worn over the user's shoulder in a standard fashion, and as a result, point A is located behind the user's neck. The distance between points A and D may effectively be adjusted by changing the position of pull 48 along zipper 36, that is, by opening or closing the zipper. This adjustment, combined with the ability to separately adjust the length of each strap arm, allows the user to adjust the distance that point A rests below the nape of the neck. This allows the user to adjust the position of the bag on his or her back for maximum comfort.

The shoulder strap mode of the present invention is shown in FIG. 2. To convert the bag from the backpack mode to the shoulder strap mode, both connectors 58 and 60 on first strap arm 50 and second strap arm 52, respectively, are disconnected from rings 62 and 64. Both connectors 58 and 60 are then reconnected to a single ring 66 that is connected to side panel 20 near a lower outer edge thereof. Zipper 36 is then preferably completely closed to effectively define a single strap, which may be worn over one shoulder. When zipper 36 is closed the strap system defines a single strap having one upper end and two lower ends.

As with the backpack mode, the length of the strap in the shoulder bag mode may be varied according to user preference with adjusters 66, 68. With the first (or upper) end 38 of strap 34 connected to bag 12 at swivel connector 40, and the connectors 58 and 60 connected to ring 66 positioned on side panel 20, the strap is in the shoulder strap mode and the strap preferably is oriented over side panel 20 as shown in FIG. 2.

In the preferred embodiment shown in the figures the strap is converted from the single-strap shoulder bag mode to the double-strap backpack mode by adjusting zipper 36, which essentially divides strap 34 longitudinally along a substantial portion of the length of the strap. However, alternately the strap may be longitudinally divided without including a zipper or other means for interconnecting the first and second strap arms. Thus, in this embodiment the bag may be utilized as a shoulder bag even though the first and second strap arms are not connected. Furthermore, other means of connecting the two strap arms are equally functional as zipper 36. For instance, the two strap arms may be interconnected with hook and eyelet-type fasteners, with snaps and other known means for releasably fastening objects.

The teardrop shape of bag 12, combined with the strap system 14 as described above, allows the bag to be adjusted to suit the needs and comfort of the user, whether the bag is worn in the backpack or shoulder bag mode. In both the backpack and shoulder bag mode, the teardrop shape of the bag tends to align with the curves of the user's body, reducing stress and fatigue.

While the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. A multimode carrying bag configured for use as a backpack and as a shoulder bag, comprising:

a bag formed of front and rear walls interconnected with side and bottom walls to define a compartment and a bag having a top and a bottom;

a strap having a single first end connected to the top of the bag, said strap including means for selectively longitudinally dividing and connecting along a substantial length thereof from a point below and spaced from said first end to define when divided a first strap arm having a second end with a releasable connector attached thereto, and a separate second strap arm having a second end with a releasable connector attached thereto, and when said strap is longitudinally connected a substantially unitary single strap;

a pair of connecting rings, each attached in spaced apart relationship to said bag, and each for selective cooperative engagement with one of said releasable connectors for defining a backpack mode for carrying said bag; and a connecting ring attached to said bag for selective cooperative engagement with both of said releasable connectors for defining a shoulder bag mode for carrying said bag when said strap is longitudinally connected.

2. The multimode carrying bag of claim 1 in which the bag is substantially triangular in shape, said triangle defining an apex and two base corners, and wherein the first end of the strap is connected to said bag near the apex.

3. The multimode carrying bag of claim 2 in which the first end of the strap is connected to said bag with a swivel.

4. The multimode carrying bag of claim 2 in which one of the pair of connecting rings is attached to the bag adjacent one of the base corners and the other connecting ring is attached to the bag adjacent the other base corner.

5. The multimode carrying bag of claim 1 in which said means comprising a zipper in the strap extending along said substantial length thereof, said zipper openable to selectively longitudinally divide said strap to define said first strap arm and said second strap arm for defining the backpack mode, and said zipper closable to selectively define said substantially unitary single strap for defining the shoulder bag mode.

6. The multimode carrying bag of claim 1 further including a zipper in a side wall to define an opening into the compartment and for selectively opening and closing said opening.

7. In a bag formed of front and rear walls interconnected with side and bottom walls to define a compartment, said bag further having a top and a bottom, said bag configured for conversion between a backpack mode in which the bag includes a pair of carrying straps, and a shoulder bag mode in which the bag includes a single carrying strap, the improvement comprising:

a carrying strap having a single first end connected to the top of the bag, said carrying strap including a zipper extending longitudinally along a substantial length of said strap beginning from a point adjacent said single first end to selectively define when the zipper is in an open position a divided carrying strap having a first carrying strap arm having a second end with a releasable connector attached thereto, and a second carrying strap arm having a second end with a releasable connector attached thereto, and when the zipper is in the closed position a substantially unitary single carrying strap having a pair of second ends, each with a releasable connector attached thereto;

a pair of connecting rings, each attached in spaced apart relationship to the front wall of said bag, each connecting ring configured for cooperative engagement with one of said releasable connectors when the bag is in the backpack mode; and a connecting ring attached to a side wall of said bag for cooperative engagement with both of said releasable connectors when the bag is in the shoulder bag mode.

8. The bag of claim 7 in which the bag is substantially triangular in shape having an apex and a pair of laterally opposed bottom corners, wherein said first end of said carrying strap is connected to the bag at the apex thereof with a swivel, and said pair of connecting rings are attached to said bag adjacent said opposed bottom corners.

9. The bag of claim 7 further including a zipper in a side wall to define a selectively openable and closable opening into the compartment.

10. A bag having front, back, side and bottom walls defining a compartment, said bag having a top and a bottom, in combination with a carrying strap system enabling said bag to be converted to multiple carrying modes, said carrying strap system comprising:

a single strap having a first end attached to said bag at the top thereof, said strap including a zipper for selectively longitudinally dividing and connecting said strap along a substantial length thereof from a point below and spaced from said first end to define when divided a first strap arm and a second strap arm, each of said strap arms having a second end, and including a releasable connector attached to each of said second ends, and when connected a substantially unitary single strap having a pair of releasable connectors at a second end thereof;

a pair of connecting rings each attached in spaced apart relationship to the front wall of said bag adjacent the bottom thereof for selective cooperative engagement with one of said releasable connectors for defining a backpack mode for carrying said bag; and a connecting ring attached to a side wall of said bag adjacent the bottom of said bag for selective cooperative engagement with both of said releasable connectors for defining a shoulder bag mode for carrying said bag.

11. The carrying strap system of claim 10 in which the bag is substantially triangular in shape.

* * * * *